US009931761B2

(12) United States Patent
Jarck

(10) Patent No.: US 9,931,761 B2
(45) Date of Patent: Apr. 3, 2018

(54) STEAM PRESSING APPARATUSES, SYSTEMS, AND METHODS

(71) Applicant: TimTek, LLC, Clarkesville, GA (US)

(72) Inventor: Walter Jarck, Clarkesville, GA (US)

(73) Assignee: TIMTEK, LLC, Clarkesville, GA (US)

( * ) Notice: Subject to any disclaimer, the term of this patent is extended or adjusted under 35 U.S.C. 154(b) by 652 days.

(21) Appl. No.: 14/341,109

(22) Filed: Jul. 25, 2014

(65) Prior Publication Data

US 2015/0028511 A1 Jan. 29, 2015

Related U.S. Application Data

(60) Provisional application No. 61/858,415, filed on Jul. 25, 2013.

(51) Int. Cl.
*B27N 3/00* (2006.01)
*B27N 3/08* (2006.01)

(52) U.S. Cl.
CPC ..... *B27N 3/086* (2013.01)

(58) Field of Classification Search
CPC .. B27N 3/086; B27N 3/08; B29C 2043/5808; B29C 2043/5825; B29C 43/003;
(Continued)

(56) References Cited

U.S. PATENT DOCUMENTS 306,476 A 10/1884 Fremerey
442,735 A 12/1890 Stewart
(Continued)

FOREIGN PATENT DOCUMENTS

GB 2 176 791 1/1987
WO WO85/02366 6/1985
(Continued)

OTHER PUBLICATIONS

College of Forest Resources, Mississippi State University, Forest & Wildlife Research Center, "The Use of Antioxidants to Increase the Effectiveness of Wood Preservatives," online, retrieved on Dec. 4, 2006, URL:http://www.cfr.msstate.edu/fwrc/forest/anti.htm.
(Continued)

*Primary Examiner* — Christina Johnson
*Assistant Examiner* — Xue Liu
(74) *Attorney, Agent, or Firm* — Morris, Manning & Martin, LLP; John R. Harris; Daniel E. Sineway

(57) ABSTRACT

According to one embodiment, the steam pressing apparatus generally comprises a substantially rectangular or square-shaped inner chamber (such as an autoclave) and an outer, generally rectangular or square-shaped structure. In one embodiment, the steam pressing apparatus comprises a hydraulic system used to compress and treat a working material with high efficiency, timing and precision. In one aspect, the steam pressing apparatus comprises a structure and system that allows modularity and scalability for manufacturing final products of varying dimensions. Further, the steam pressing apparatus can be designed to respond to computerized instructions relating to the pressure to be applied, steam to be applied, vacuum parameters, timing of the press operation, thickness of the resultant working material, and other informational inputs.

13 Claims, 11 Drawing Sheets

(58) Field of Classification Search
CPC ..... B29C 43/36; B29C 43/02; B29C 43/52; B29C 43/04; B29C 43/156
USPC ..... 264/319, 330, 83, 82
See application file for complete search history.

(56) References Cited

U.S. PATENT DOCUMENTS

| | | | | |
|---|---|---|---|---|
| 763,338 | A | 6/1904 | Baker | |
| 3,508,523 | A | 4/1970 | Meerleer | |
| 3,870,665 | A | 3/1975 | Diehr et al. | |
| 3,891,738 | A | 6/1975 | Shen | |
| 4,232,067 | A | 11/1980 | Coleman | |
| 4,393,019 | A | 7/1983 | Geimer | |
| 4,517,147 | A | 5/1985 | Taylor et al. | |
| 4,605,467 | A | 8/1986 | Bottger | |
| 4,655,869 | A | 4/1987 | Tellman et al. | |
| 4,675,066 | A | 6/1987 | Honda | |
| 4,684,489 | A | 8/1987 | Walter | |
| 4,695,345 | A | 9/1987 | Grace | |
| 4,695,435 | A | 9/1987 | Spector | |
| 4,704,316 | A | 11/1987 | Grace | |
| 4,711,684 | A | 12/1987 | Coleman | |
| 4,711,689 | A | 12/1987 | Coleman | |
| 4,827,423 | A | 5/1989 | Beasley et al. | |
| 4,937,024 | A | 6/1990 | Hickson | |
| 5,106,697 | A | 4/1992 | Whittemore | |
| 5,161,591 | A | 11/1992 | Sealey et al. | |
| 5,246,652 | A | 9/1993 | Hsu et al. | |
| 5,279,691 | A | 1/1994 | Stickland | |
| 5,441,787 | A | 8/1995 | Fujii et al. | |
| 5,465,464 | A | 11/1995 | Chen et al. | |
| 5,492,756 | A | 2/1996 | Seale et al. | |
| 5,505,238 | A | 4/1996 | Fujii et al. | |
| 5,662,760 | A | 9/1997 | Tsuda | |
| 5,755,917 | A | 5/1998 | Barnes | |
| 5,972,266 | A | 10/1999 | Fookes et al. | |
| 6,030,562 | A | 2/2000 | Lehtinen et al. | |
| 6,098,679 | A | 8/2000 | Go et al. | |
| 6,187,234 | B1 | 2/2001 | Bonomo et al. | |
| 6,263,773 | B1 | 7/2001 | McAdoo et al. | |
| 6,312,540 | B1 * | 11/2001 | Moyes | B27N 7/00 156/219 |
| 6,318,046 | B1 | 11/2001 | Horsfield et al. | |
| 6,344,165 | B1 | 2/2002 | Coleman | |
| 6,428,871 | B1 | 8/2002 | Cozzolino | |
| 6,533,890 | B1 | 3/2003 | Berger et al. | |
| 6,569,540 | B1 | 5/2003 | Preston et al. | |
| 6,635,141 | B2 | 10/2003 | Horsfield et al. | |
| 6,695,944 | B2 | 2/2004 | Courtney | |
| 6,762,314 | B2 | 7/2004 | Partridge et al. | |
| 6,818,317 | B2 | 11/2004 | Hejna et al. | |
| 6,868,644 | B2 * | 3/2005 | Frankefort | B27N 3/08 264/294 |
| 6,868,877 | B2 | 3/2005 | Lines | |
| 6,938,541 | B2 | 9/2005 | Vomberg | |
| 7,004,215 | B2 | 2/2006 | Knokey et al. | |
| 7,141,193 | B2 | 11/2006 | Mbachu et al. | |
| 7,258,826 | B2 | 8/2007 | Bales | |
| 7,264,796 | B2 | 9/2007 | Hejna et al. | |
| 7,439,280 | B2 | 10/2008 | Lu et al. | |
| 7,507,360 | B2 | 3/2009 | Jarck | |
| 7,537,031 | B2 | 5/2009 | Jarck | |
| 7,537,669 | B2 | 5/2009 | Jarck | |
| 7,678,309 | B2 | 3/2010 | Jarck | |
| 7,838,446 | B2 | 11/2010 | Jarck | |
| 8,075,717 | B2 | 12/2011 | Parker | |
| 8,075,735 | B2 | 12/2011 | Jarck | |
| 8,468,715 | B2 | 6/2013 | Thomas, Jr. et al. | |
| 8,776,681 | B2 | 7/2014 | White et al. | |
| 2003/0224179 | A1 | 12/2003 | Skinner et al. | |
| 2005/0257888 | A1 | 11/2005 | Williamson et al. | |
| 2006/0086283 | A1 | 4/2006 | Ray | |
| 2009/0165961 | A1 * | 7/2009 | Sanchez | B27N 3/08 156/581 |
| 2015/0115493 | A1 | 4/2015 | White et al. | |
| 2016/0243720 | A1 | 8/2016 | Rooney et al. | |

FOREIGN PATENT DOCUMENTS

| | | |
|---|---|---|
| WO | WO85/02367 | 6/1985 |
| WO | WO85/02368 | 6/1985 |
| WO | WO85/02369 | 6/1985 |
| WO | WO85/02370 | 6/1985 |
| WO | WO88/04983 | 7/1988 |
| WO | WO89/11383 | 11/1989 |
| WO | WO2006/036713 | 4/2006 |

OTHER PUBLICATIONS

Schultz TP et al., "Development of environmentally-benign wood preservatives based on the combination of organic biocides with antioxidants and metal chelators," Phytochemistry, Nov. 2002, 61(5):555-60. Abstract.

* cited by examiner

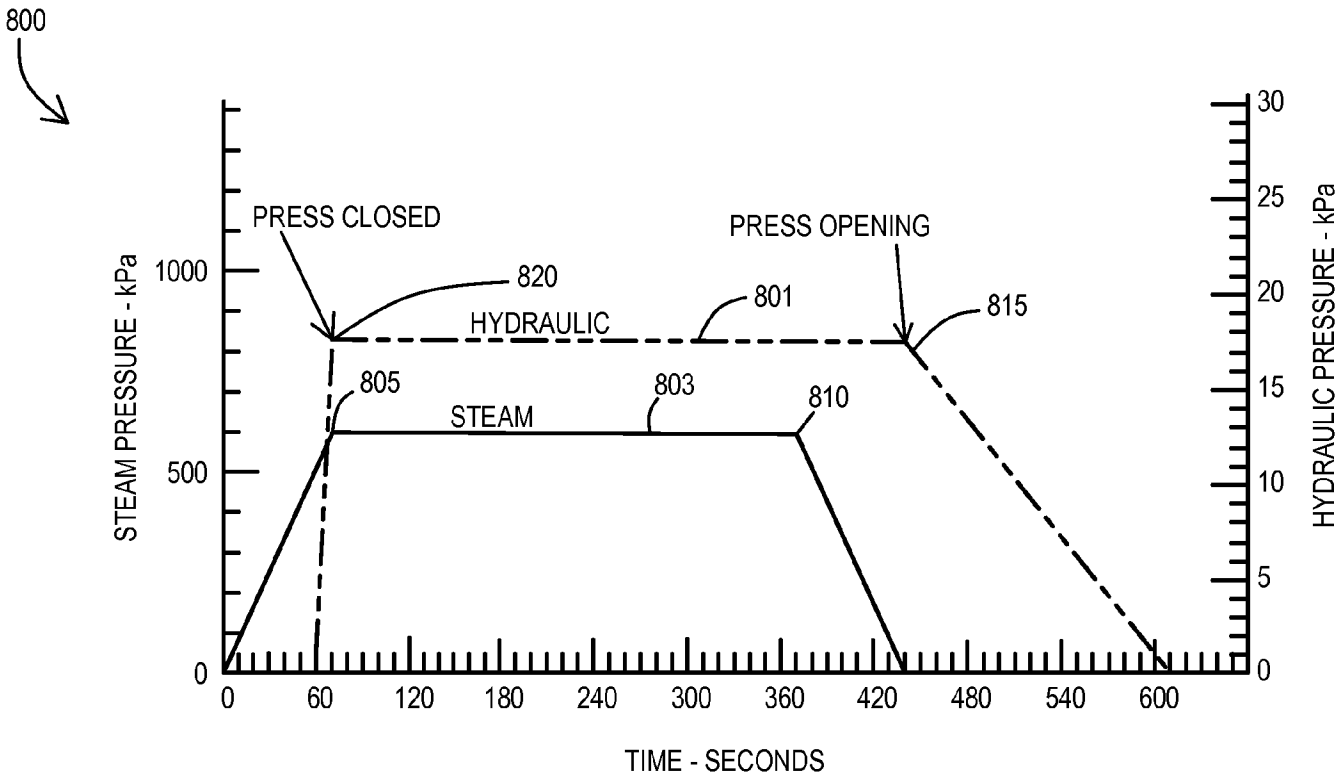
*FIG. 8* - EXEMPLARY OPERATING TIMES AND PRESSURES

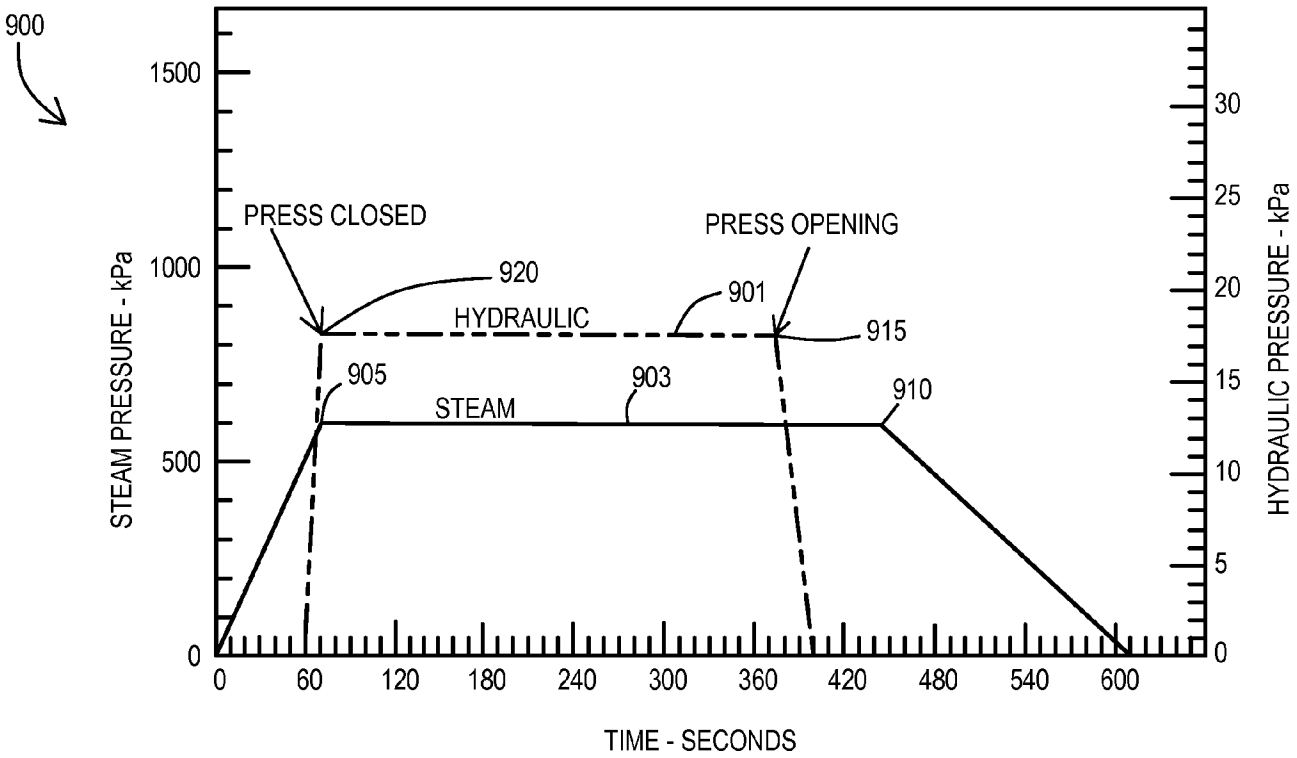
*FIG. 9* - EXEMPLARY OPERATING TIMES AND PRESSURES

STEAM PRESSING APPARATUSES, SYSTEMS, AND METHODS

CROSS REFERENCE TO RELATED APPLICATION

This application claims benefit under 35 U.S.C. § 119(e) and priority to U.S. Provisional Patent Application No. 61/858,415, filed Jul. 25, 2013 and entitled "Improved Steam Pressing Apparatus", which is incorporated herein by reference as if set forth herein in its entirety.

TECHNICAL FIELD

The present disclosure generally relates to improved steam pressing apparatuses, and more particularly to methods, devices, and apparatuses for use in the manufacture of products using steam pressing.

BACKGROUND

In certain industries, it is necessary to utilize pressing apparatuses such as in the manufacture of plastic, steel, and wood products, among others. These pressing apparatuses are generally employed to compress a working material during the manufacturing process to create a final product. For example, some known pressing apparatuses in the timber industry compress a charge of wood components to form a final wood product. In some cases, steam is used in the pressing process to supply heat for plasticizing the working material (e.g., strands of crushed wood or wood fibers) and for curing any bonding agent applied to the working material. In particular, U.S. Pat. No. 6,344,165, entitled "Manufacture of Reconsolidated Wood Products," U.S. Pat. No. 7,537,031, entitled "A System and Method for the Manufacture of Reconsolidated or Reconstituted Wood Products," and U.S. Pat. No. 7,537,669, entitled "Systems and Methods for the Production of Steam-Pressed Long Fiber Reconsolidated Wood Products," all describe aspects of steam pressing and steam apparatuses in connection with manufacturing reconsolidated wood products.

Such conventional methods and apparatus, however, have significant drawbacks. For example, current pressing systems possess deficiencies in accuracy, timing, and precision during the manufacturing processes that impact the quality of the resultant product. Also, the structure of conventional apparatuses limits the manufacture of products of varying thickness and sizes. Additionally, previous technologies utilize a single entry point to the pressing enclosure where the working product is treated, which reduces production efficiency.

Further, conventional methods and apparatuses are prone to human errors and inaccuracies during the manufacturing process. During that process, apparatuses have traditionally used rudimentary platens which are inappropriate to produce wood products in curved shapes or other non-conventional patterns. Hydraulic cylinders that might move those platens have been generally placed inside of the enclosure where the working material is treated, which causes detrimental heat to the hydraulic oil. Furthermore, the apparatuses used during the manufacturing process are generally small, self-contained units inappropriate to enable scalability and modularity. Additionally, most prior apparatuses are unsuitable for introducing components (e.g., chemicals) to treat the working material at different stages of the manufacturing process.

Therefore, it is an aim of the present disclosure to provide methods and apparatuses that overcome and improve upon existing methods and devices for the forming of steam-pressed reconstituted or reconsolidated products, such as wood and timber products.

BRIEF SUMMARY OF THE DISCLOSURE

Aspects of the present disclosure generally relate to improved steam pressing apparatuses, and more particularly to methods, devices, and apparatuses for use in the manufacture of products using steam pressing.

According to one embodiment, aspects of the present steam pressing apparatus generally comprise a substantially rectangular or square-shaped inner chamber (such as an autoclave) and an outer, generally rectangular or square-shaped structure. In one embodiment, the steam pressing apparatus comprises a hydraulic system used to compress and treat a working material with high efficiency, timing, and precision. In one aspect, the steam pressing apparatus comprises a structure and system that allows modularity and scalability for manufacturing final products of varying dimensions. Further, in another aspect, the apparatus contains sliding doors arranged in such a way as to improve efficiency during the manufacturing process. Additionally, in one aspect, the apparatus comprises a platen with a non-conventional shape for manufacturing wood products of different shapes. Further, the steam pressing apparatus can be designed to respond to computerized instructions relating to the pressure to be applied, steam to be applied, vacuum parameters, timing of the press operation, thickness of the resultant working material, and other informational inputs.

These and other aspects, features, and benefits of the claimed disclosure(s) will become apparent from the following detailed written description of the preferred embodiments and aspects taken in conjunction with the following drawings, although variations and modifications thereto may be effected without departing from the spirit and scope of the novel concepts of the disclosure.

BRIEF DESCRIPTION OF THE DRAWINGS

The accompanying drawings illustrate one or more embodiments and/or aspects of the disclosure and, together with the written description, serve to explain the principles of the disclosure. Wherever possible, the same reference numbers are used throughout the drawings to refer to the same or like elements of an embodiment, and wherein:

FIG. 8 is a graph illustrating exemplary operating times and pressures of one embodiment of the present disclosure.

FIG. 9 is a graph illustrating exemplary operating times and pressures of one embodiment of the present disclosure.

DETAILED DESCRIPTION

Figure 1:
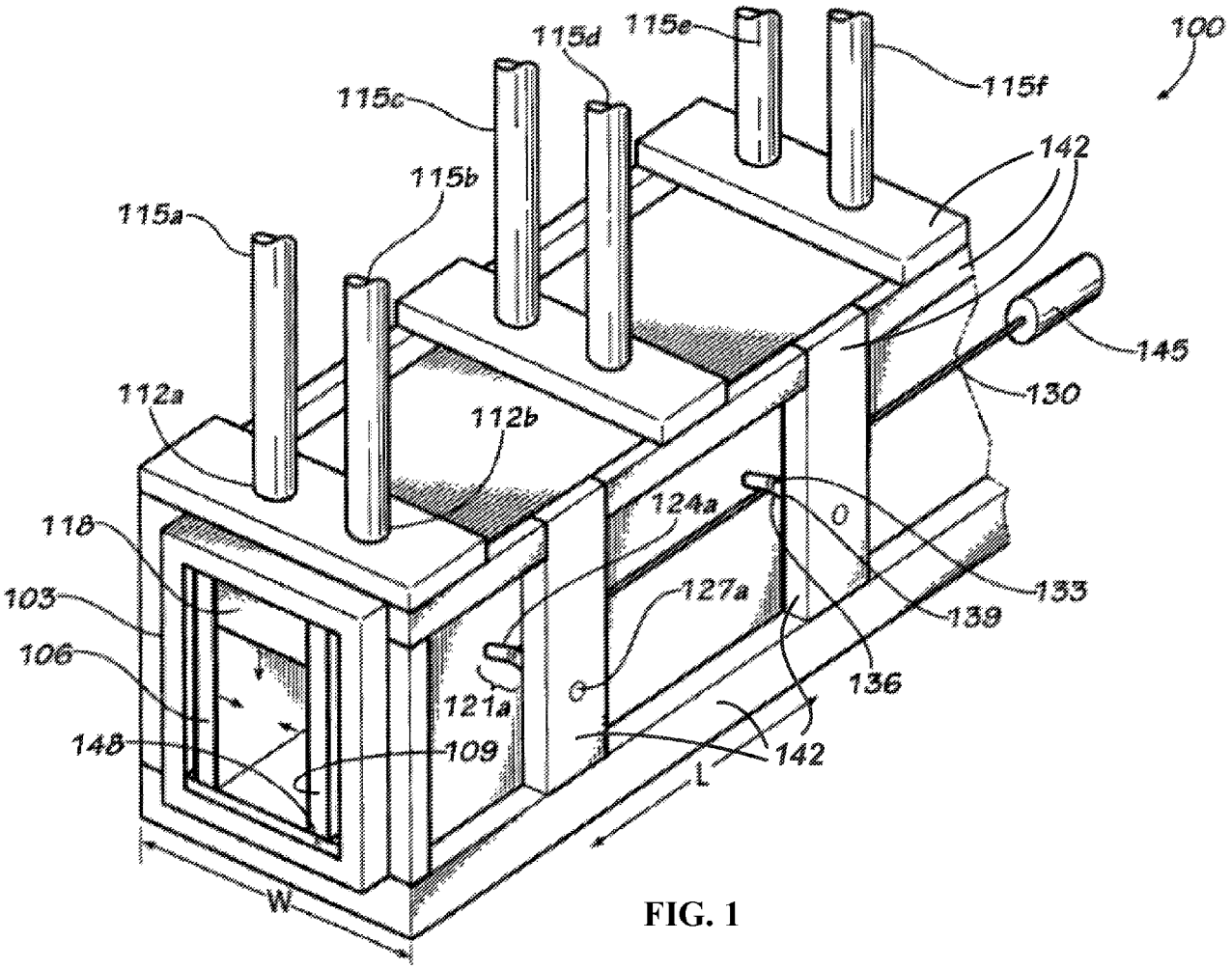
FIG. 1 is a perspective view of an exemplary embodiment of a steam pressing apparatus, according to one embodiment of the present disclosure.

For the purpose of promoting an understanding of the principles of the present disclosure, reference will now be made to the embodiments illustrated in the drawings and specific language will be used to describe the same. It will, nevertheless, be understood that no limitation of the scope of the disclosure is thereby intended; any alterations and further modifications of the described or illustrated embodiments, and any further applications of the principles of the disclosure as illustrated therein are contemplated as would normally occur to one skilled in the art to which the disclosure relates.

Throughout this specification, the term "comprise" or variations such as "comprising" or "comprises" will be understood to imply the inclusion of a stated integer (or component) or group of integers (or components), but not the exclusion of any integer (or component) or group of integers (or components). The singular forms "a", "an", and "the" include the plurals unless the context clearly dictates otherwise.

Overview

Aspects of the present disclosure generally relate to improved steam pressing apparatuses, and more particularly to methods, devices, and apparatuses for use in the manufacture of products using steam pressing.

According to one embodiment, aspects of the present steam pressing apparatus generally comprise a substantially rectangular or square-shaped inner chamber (such as an autoclave) and an outer, generally rectangular or square-shaped structure. In one embodiment, the steam pressing apparatus comprises a hydraulic system used to compress and treat a working material with high efficiency, timing, and precision. In one aspect, the steam pressing apparatus comprises a structure and system that allows modularity and scalability for manufacturing final products of varying dimensions. Further, in another aspect, the apparatus contains sliding doors arranged in such a way as to improve efficiency during the manufacturing process. Additionally, in one aspect, the apparatus comprises a platen with a non-conventional shape for manufacturing wood products of different shapes. Further, the steam pressing apparatus can be designed to respond to computerized instructions relating to the pressure to be applied, steam to be applied, vacuum parameters, timing of the press operation, thickness of the resultant working material, and other informational inputs.

Exemplary Embodiments

Referring now to the drawings, in which like numerals illustrate like elements throughout several drawing figures, FIG. 1 illustrates one embodiment of steam pressing apparatus 100. In one non-limiting example, during operation of the apparatus 100, a charge of wood components located inside the apparatus is steamed and compressed to form firstly a mat and then a resultant product. The steam pressing apparatus 100 generally comprises a substantially rectangular or square-shaped inner chamber such as an autoclave 103 and an outer, generally rectangular or square-shaped structure. In one aspect, the apparatus 100 comprises at least two opposite facing side plates 106, 109. In one exemplary embodiment, the apparatus 100 is capable of manufacturing a wood product having at least a width up to 4 feet or 1.22 meters (m) and a thickness up to 7 inches or 0.178 m. In other embodiments, the size, width, and length of the resultant wood product (or other material product) can have a variety of dimensions, as will occur to one of ordinary skill in the art.

In one embodiment, one or more aperture or sealing arrangements 112 are located on the top surface of the autoclave 103 to accommodate driving rods 115. In another embodiment, one or more driving rods 115 are received through aperture or sealing arrangements 112 for axial movement therethrough. A generally rectangular heated top platen 118 is connected to the innermost end of the driving rods 115 for movement in accordance with the corresponding movement of the driving rods 115. When in operation, the autoclave 103 is sealed, and the driving rods 115 are operated to lower the top platen 118 to contact the upper surface of the working material located inside of the autoclave 103. In one aspect, steam is introduced before or at the same time that the working material is compressed into a mat. In another aspect, steam is introduced into the autoclave 103 through steam inlets and conduits before and/or after the charge of wood components has been compressed to the desired thickness. A bonding agent is generally applied to the working material and may contain chemicals for treating the working material (e.g., preservatives, chemical repellants, etc.). Generally, the working material (e.g., reconsolidated wood product) is compressed on top of a heated bottom platen 148.

Side Pressing

In one embodiment, a hydraulic system is used to compress the working material with high efficiency, timing, and precision. In one aspect, side plates 106, 109 comprise two identical plates positioned parallel to the sides of the autoclave 103, where each side plate or wall 106, 109 generally rests in proximity to opposite sides of the autoclave 103. As illustrated in FIG. 1, each side wall is connected to the innermost end of at least one mechanical linkage 121 for movement in accordance with the corresponding movement of the linkage. Generally, the side plates 106, 109 move axially towards the center of the autoclave 103 to compress the working material inwardly, and are capable of preventing the working material from escaping the platens 103 as pressure is being applied. As illustrated in FIG. 1, the side plates 106, 109 move to compress the working material until they abut the top platen 118, which has a preferred width of 48 inches may comprise virtually any width. In operation of the steam pressing apparatus 100, the movement of the side plates 106, 109 can be, but is not necessarily synchronized with the movement of the top platen 118, and the order of operation may comprise any form desirable or convenient at a particular time.

In one aspect illustrated in FIG. 1, a plurality of linkages 121 is connected perpendicularly to a side plate 109 through a plurality of apertures or sealing arrangements 124. The other side wall 106 is connected to a similar plurality of linkages through a plurality of apertures or sealing arrangements (not shown). In one aspect, the linkages 121 comprise an arrangement of at least two links 133, 136. The outermost end of each linkage 121 is attached to a side wall 109 through a sealing arrangement 124, whereas the innermost end of each linkage 121 is attached to a supporting structure 142 outside of the autoclave, and each linkage 121 is attached to a location 127 on the supporting structure 142 most convenient to provide axial displacement in accordance with the movement of the side plates 106, 109. In one embodiment, a side hydraulic cylinder 145 is used to apply a unidirectional force to the linkages 121 in accordance with their axial displacement. The piston rod 130 of the side hydraulic cylinder 145 axially extends parallel to the side plates 106, 109 and attaches to the linkages 121 at a position most desired to provide pressure to the linkages 121 that cause them to move in accordance with the movement of the side plates 106, 109.

Figure 2A:
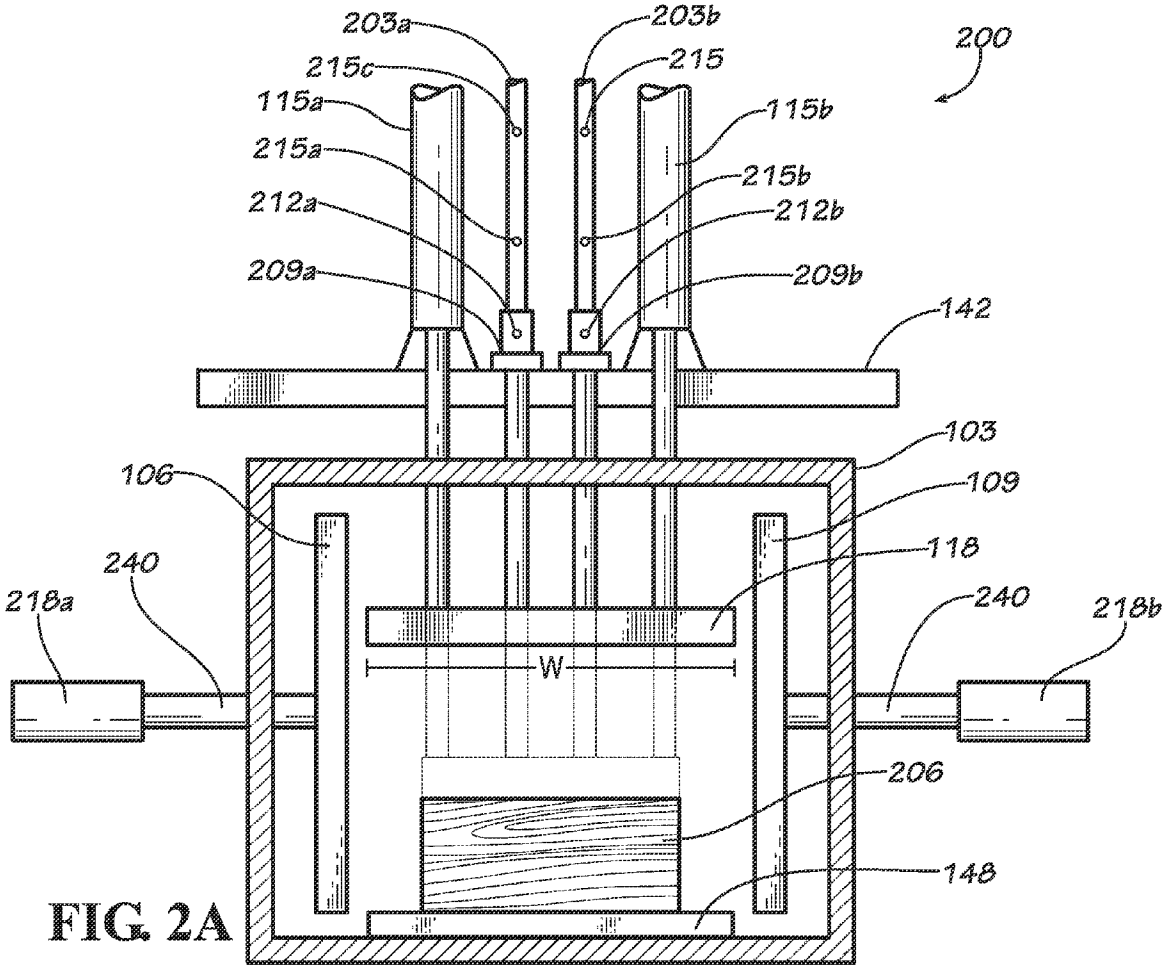
FIG. 2A is a cross-sectional view of an exemplary working material height adjustment apparatus, according to one embodiment of the present disclosure.
Figure 2B:
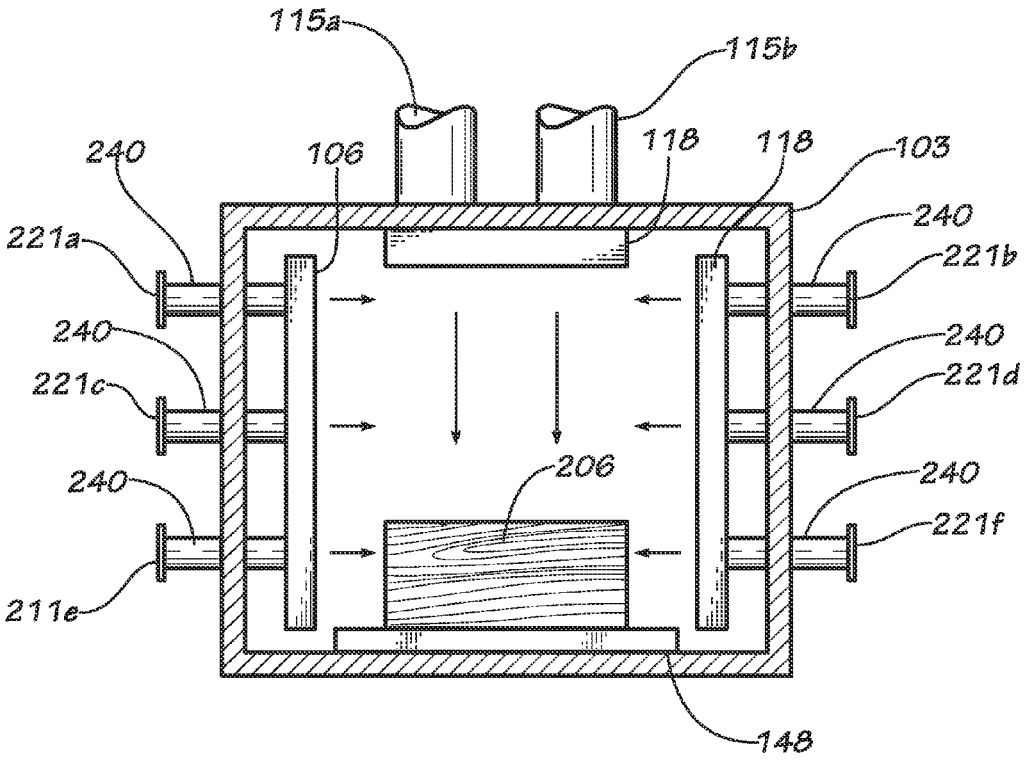
FIG. 2B is a cross-sectional view of an exemplary working material height adjustment apparatus, according to one embodiment of the present disclosure.

In other embodiments, such as those shown in FIGS. 2A, 2B, the side plates 106, 109 are moved inwardly and outwardly from the autoclave via pressing rods 240 that are controlled by hydraulic cylinders or other movement means. In yet other embodiments, the side plates 106, 109 are moved via pulley assemblies, chain and link assemblies, or other movement means (not shown).

Supporting Structure

In one embodiment, the supporting structure 142 consists of a modular system of rigid members around the autoclave 103 attached to each other to provide stability and a point of attachment to the elements of the steam pressing apparatus 100. Generally, the supporting structure 142 comprises vertical members that transfer the mass of the apparatus 100 to the ground, where the members rest on a base plate or a plurality of horizontal members. In another embodiment, additional horizontal members connect between the vertical members, which hold the vertical members in place and provide support for the entire apparatus 100. In one aspect, the supporting structure contains horizontal members that support the driving rods 115 and are received through sealing arrangements 112 in the horizontal members for axial movement therethrough. In one aspect, the autoclave 103 is secured to the supporting structure 142.

Working Material Height Adjustment

In one embodiment, the autoclave contains at least one mechanical system 200 for stopping the vertical movement of the top platen 118. In one aspect illustrated in FIG. 2A, the mechanical system 200 comprises a pair of mechanical stops 209 for halting the vertical movement of the top platen 118, where each mechanical stop 209 generally slides over a rigid rod 203. In one embodiment, the mechanical stops 209 comprise two concentric annular bodies of equal inner diameters and different outer diameters. Each annular body comprises a first planar side, a second planar side parallel and identical to the first planar side, and an inner peripheral wall and an outer peripheral wall connecting the first and second planar sides. Generally, the two annular bodies are attached to each other at one of their planar sides forming an inner annular space having approximately the same diameter of the rigid rods 203.

In one embodiment, each rigid rod 203 extends vertically parallel to the driving rods 115, and each rod 203 is attached to the top platen 118. Generally, the annular body with the smaller outer diameter in the mechanical stops 209 has an opening 212 that completely penetrates the annular body through the center of its peripheral walls. The rods 203 have one or more openings 215 along their peripheral surface in accordance with the openings in the mechanical stops 209. The mechanical elements 209 can slide along the longitude of the rods; however, the mechanical elements 209 are generally placed so that a rigid body such as a pin or screw can be received through the openings in the mechanical stops 209 and the rods 203 as a means to temporarily restrict the vertical sliding movement of the mechanical stops 209.

In one aspect illustrated in FIG. 2A, one or more rigid rods 203 are received through openings in a horizontal member of the supporting structure 142. As the top platen 118 is lowered, the mechanical stops 209 and the rigid rods 203 move vertically in accordance with the movement of the top platen 118. The rigid rods 203, the mechanical stops 209 and the top platen 118 stop their vertical movement when the mechanical stops 209 contact the horizontal member of the supporting structure 142. The rigid body that temporarily restricts the movement of the mechanical stops 209 can be removed to allow the mechanical stops 209 to slide to another opening 215 in the rigid rods 203 as a means to vary the vertical position at which the top platen 118 will be stopped when the mechanical stops 209 contact the horizontal member of the supporting structure 142. This method can be repeated to manufacture wood products (or other products) of different dimensions with the same autoclave 103, where the inner space created by the top platen 108, the side plates and the bottom plate 148 determine the size of the final product 206. Preferably, the dimensions achieved with this system include a final wood product with a vertical thickness of between 1 inch and 6 inches, although other dimensions are possible as will occur to one of ordinary skill in the art.

Still referring to the embodiment illustrated in FIG. 2A, each side plate 106, 109 is moved by a hydraulic cylinder 218 positioned outside of the autoclave 103 in a position such that the piston rods 240 of the side hydraulic cylinders 218 contact the side plates 106, 109 perpendicularly. In one embodiment, the piston rods of the side hydraulic cylinders 218 contact the side plates 106, 109 at their vertical midpoint. In an alternate embodiment illustrated in FIG. 2B, each side platen 106, 109 is moved by a plurality of hydraulic cylinders 221 positioned outside of the autoclave 103 in a location such that the piston rods 240 of the side hydraulic cylinders 218 contact the side plates 106, 109 perpendicularly. Preferably, the hydraulic cylinders 221 are placed equidistantly in a manner that allows the side plates 106, 109 to receive equal surface force.

Adjustable Plate and Working Material Sizing

Figure 3A:
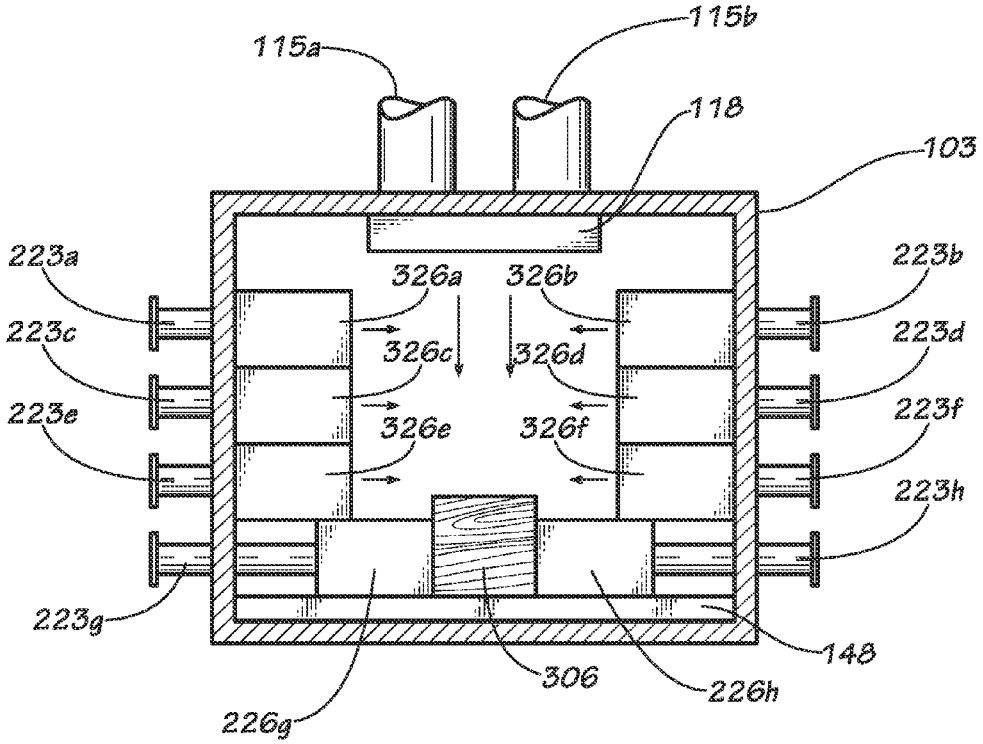
FIG. 3A is a cross-sectional view of an exemplary adjustable plate and working material sizing apparatus, according to one embodiment of the present disclosure.

In one embodiment illustrated in FIG. 3A, the working material 306 may be sized by a system comprised of a plurality of side plates or rectangular stops 326. The rectangular stops 326 are generally right-angled parallelepipeds generally resting in proximity to the sides of the autoclave 103, replacing the side plates 106, 109 shown in previous embodiments. As illustrated in FIG. 3A, half of the rectangular stops 326 rest on one side of the autoclave 103 and half of the rectangular stops 326 rest on the opposite side of the autoclave 103. In one aspect, each rectangular stop 326 is moved horizontally by a side pressure hydraulic cylinder 223. In the exemplary embodiment illustrated in FIG. 3A, an equal number of rectangular stops 326*a*-326*f* abut each side of the autoclave 103 and are vertically aligned to form a generally right-angled parallelepiped space for the top platen 118 to move vertically until each contacts the mat 306 without obstruction.

In one aspect, the rectangular stops 326 are sized so that the outermost sides of the rectangular stops 326*a*-326*f* generally abut the sides of the autoclave 103. In another aspect, the rectangular stops 326*a*-326*f* are moved horizontally until the innermost side of each rectangular stop 326*a*-326*f* are adjacent to the horizontal dimensions of of the top platen 118. Still referring to FIG. 3A, the lowest rectangular stops 326*g*, 326*h* are moved vertically until they abut the mat 306, wherein the distance between the innermost sides of the lowest rectangular stops 326*g*, 326*h* determines the vertical dimensions of the mat 306. Generally, the top platen is lowered until it contacts the upper side of the lowest rectangular stops 326*g*, 326*h*, where the inner space created by the rectangular stops 326*g*, 326*h*, the top platen 118 and the bottom plate 148 determines the size of the mat 306.

Figure 3B:
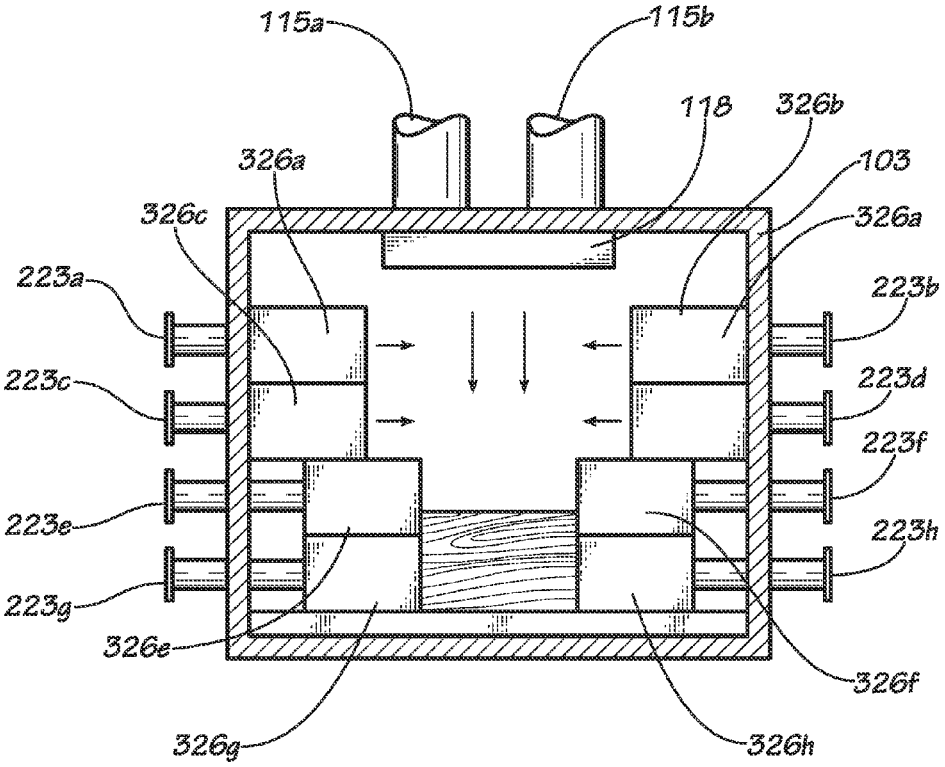
FIG. 3B is a cross-sectional view of an exemplary adjustable plate and working material sizing apparatus, according to one embodiment of the present disclosure.

As illustrated in FIG. 3B, the rectangular mechanical stops 326*e*, 326*f* can also be moved in vertical alignment with the rectangular mechanical stops 326*g*, 326*h*, where the inner space created by the rectangular stops 326*e*-326*f*, the top platen 118 and the bottom plate 148 determine the size of the mat. This method can be repeated with a different number of rectangular stops 326 in different vertical alignments to manufacture wood products of different dimensions with the same autoclave 103. The rectangular stops 326 can also have different dimensions that are convenient or desirable to form wood products of different dimensions with the same autoclave 103.

Steam Press Entry and Exit

Figure 4A:
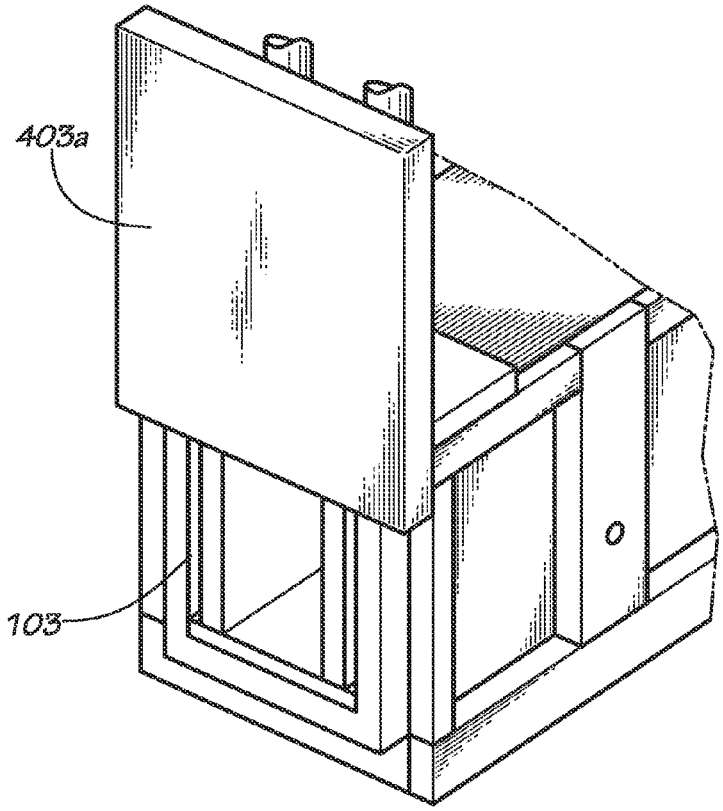
FIG. 4A is a perspective view of an exemplary steam pressing apparatus entry and exit opening, according to one embodiment of the present disclosure.

In one embodiment illustrated in FIG. 4A, a vertically sliding door 403*a* allows access to the autoclave 103. The vertical configuration prevents the vertically sliding door 403*a* from being obstructed by working material in proximity to the autoclave 103. In one aspect, the vertically sliding door is secured to the supporting structure 142 and provides an airtight closure to the autoclave 103. The vertically sliding door 403*a* prevents air and gas flow between the interior and exterior of the autoclave 103. The vertically sliding door 403*a* is designed to withstand considerable pressure experienced in the autoclave 103. Preferably, the vertically sliding 403*a* door is designed to withstand pressures of at least 120 psi or 827.37 kPa.

Figure 4B:
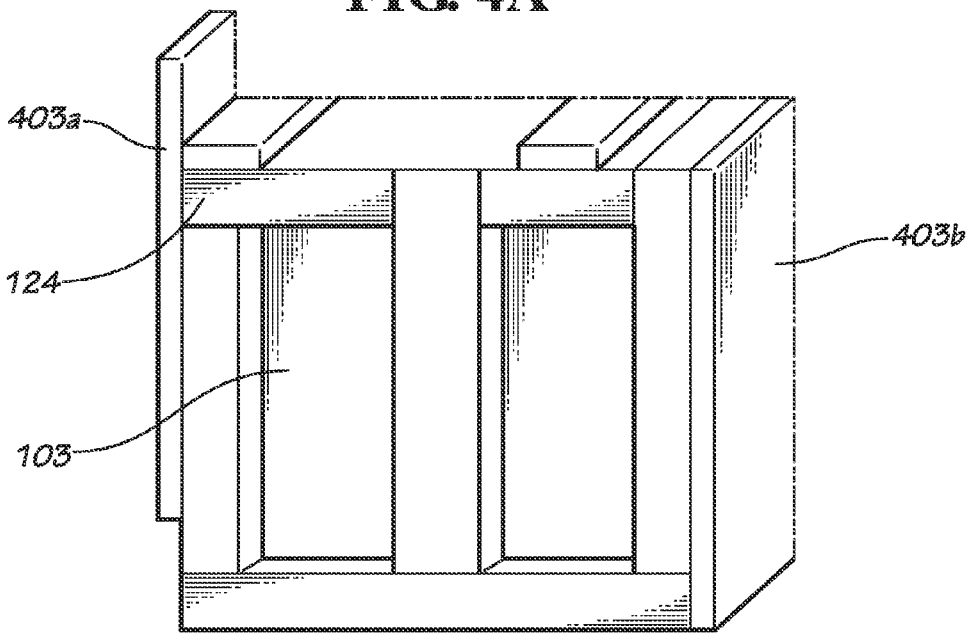
FIG. 4B is a perspective view of an exemplary steam pressing apparatus entry and exit opening, according to one embodiment of the present disclosure.

In one aspect illustrated in FIG. 4B, a vertically sliding door 403*b* is secured to the opposite side of the supporting structure 142 via a sliding track system or other conventional door-closing mechanism. One vertical sliding door 403*a* can be used as an input to the autoclave 103, whereas another vertical sliding door 403*b* (on the opposite side of the autoclave) can be used as an output to the autoclave 103. This configuration of two opposing vertically sliding doors 403 secured to the supporting structure 142 contributes to increased efficiency during the manufacture of the wood products.

Modular Architecture

In one embodiment, a modular autoclave and apparatus architecture is employed to provide scalability and flexibility to the steam pressing apparatus 100. In one embodiment, the steam pressing apparatus 100 comprises a modular autoclave 503 constructed in sections such that each section is coupled to a previous section, and all sections are encapsulated by the supporting structure 142. In an exemplary embodiment shown in FIG. 5, the steam pressing apparatus 100 comprises a modular autoclave 503 constructed in sections 503*a*-503*c* such that each section 503*a*-503*c* is coupled to a previous section, and all sections 503*a*-503*c* are encapsulated by the supporting structure 142. Each section 503*a*-503*c* generally comprises a hollow, right-angled parallelepiped, and the sections 503 are aligned so that the entire autoclave forms a longer right-angled parallelepiped. In one embodiment, each section 503 has a length from 4 feet to 12 feet or 1.22 m to 3.66 m, and, by coupling sections together, the modular autoclave 503 can achieve a length of at least 60 feet or 18.3 m. As will be understood and appreciated, however, the modular sections of the apparatus shown in FIG. 5 can be constructed of virtually any dimension or size, and a variety of sizes are possible according to various embodiments of the present disclosure.

Figure 5:
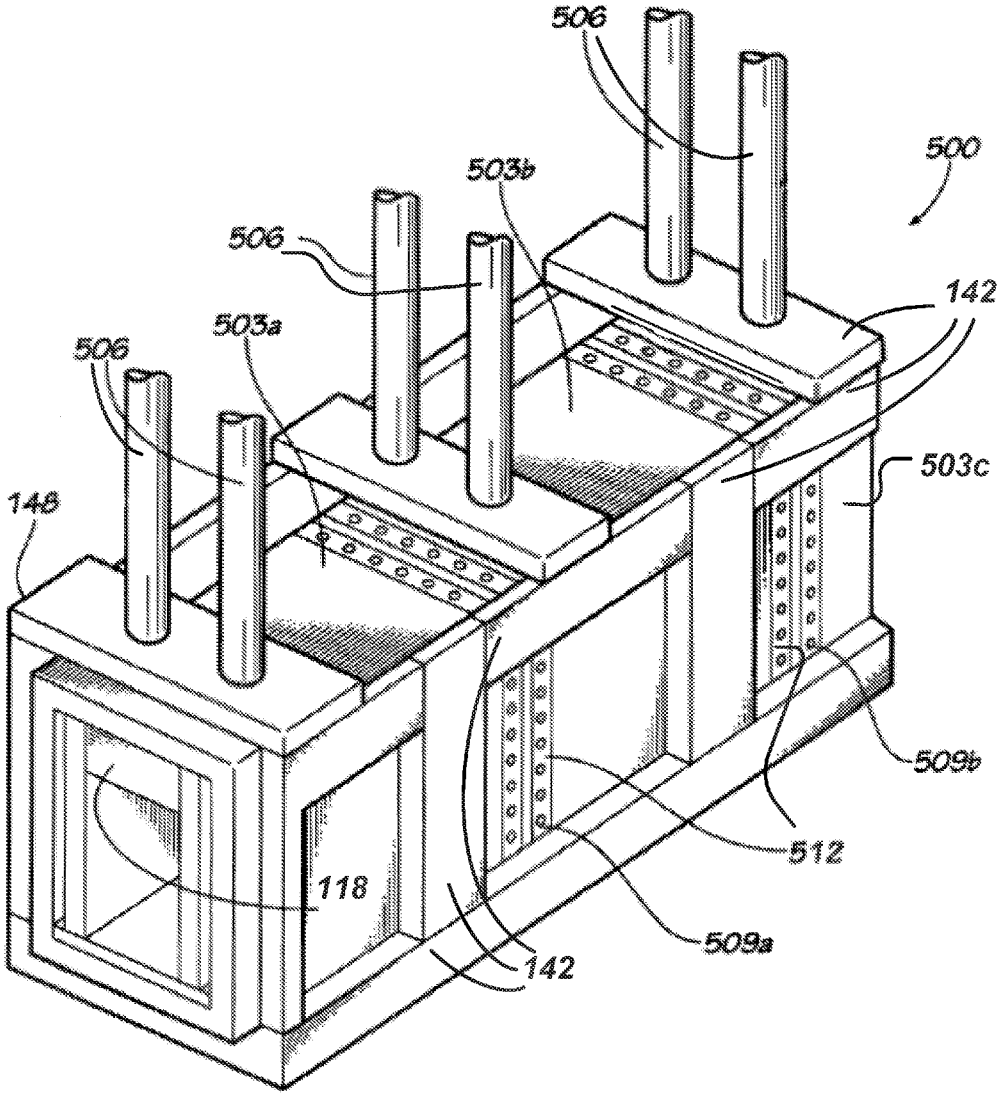
FIG. 5 is a perspective view of an exemplary modular autoclave and architecture, according to one embodiment of the present disclosure.

In the embodiment shown in FIG. 5, the supporting structure 142 is expanded with more vertical and horizontal members corresponding to the dimensions of the modular autoclave 503. In one aspect, each section 503 comprises one or more driving rods 506 and one or more top platens 118. In the exemplary embodiment shown in FIG. 5, each section has two driving rods 506 that move a top platen 118. The two driving rods 506 are placed outside of the autoclave 503 to reduce the heat generated by the hydraulic system that moves the driving rods 506 and protect its hydraulic oil from detrimental temperatures. The driving rods 506 are generally received into the autoclave 503 through a sealed brushing arrangement. In one aspect, the sections of the modular autoclave 503 are coupled by plates 509 that extend along the border of the junctions of the modular sections. As shown in FIG. 5, half of a plate 509*a* borders a section 503*a* of the modular autoclave 503, and the other half borders a section 503*b* of the adjacent modular autoclave 503. In one aspect, the plates 509 are attached to the autoclave 503 with an arrangement of screws 512 that extend equidistantly along each half of the plates 509. As will be understood and appreciated, the connections between each modular section of the autoclave should be tightly sealed to prevent loss of steam or pressure, and should comprise a substantially flat connection to avoid bows or weak points in the resultant working material.

Chemical/Steam Introduction Ports

Figure 6:
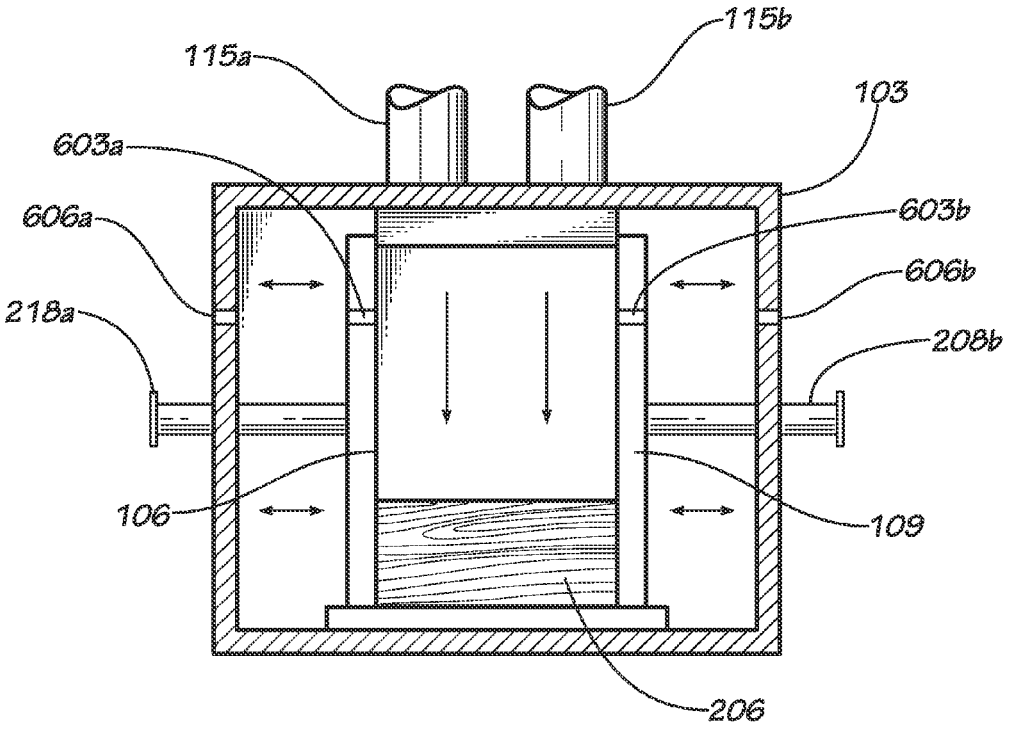
FIG. 6 is a cross-sectional view of an exemplary autoclave with steam/chemical injection ports, according to one embodiment of the present disclosure.

In one embodiment illustrated in FIG. 6, the autoclave 103 has one or more steam ports 603, 606 to permit rapid flow and even distribution of steam through the autoclave 103 and into the working material 206. In one aspect, the apparatus 100 is designed for low-pressure steam less than or equal to 120 psi or 827.37 kPa and 350° F. or 176.67° C., but is not limited to such parameters and other parameters are possible as will occur to one of ordinary skill in the art. Preferably, the steam ports 603, 606 have a diameter of 0.5 inches to 2.0 inches or 0.013 m to 0.051 m and are placed longitudinally along the sides of the autoclave 103 every 2-4 feet or 0.61 m-1.22 m. As will be understood, however, the dimensions can be varied as needed by one of ordinary skill in the art. As shown in FIG. 6, some ports 603*b* are located on the sides of the autoclave 103 to admit steam into the autoclave 103, and some ports 603*a* are located on the side plates 106, 109 to admit the steam into the mat 206. Preferably, the ports 603*a* located on the plates are placed lower than the top platen 118 and higher than the charge of wood components in a manner that the steam can be admitted unobtrusively to form the mat 206.

In one aspect, the steam ports can be used for the introduction of one or more chemicals, preservatives, or other treatments to the working material before compressing them into the mat 206. In another aspect, the steam and chemicals are introduced through systems with separate valves. Therefore, this system allows introducing harmful chemicals after the working material is placed in the autoclave 103 isolated from unprotected personnel that may be working with the working material.

Shaped Platens

Figure 7A:
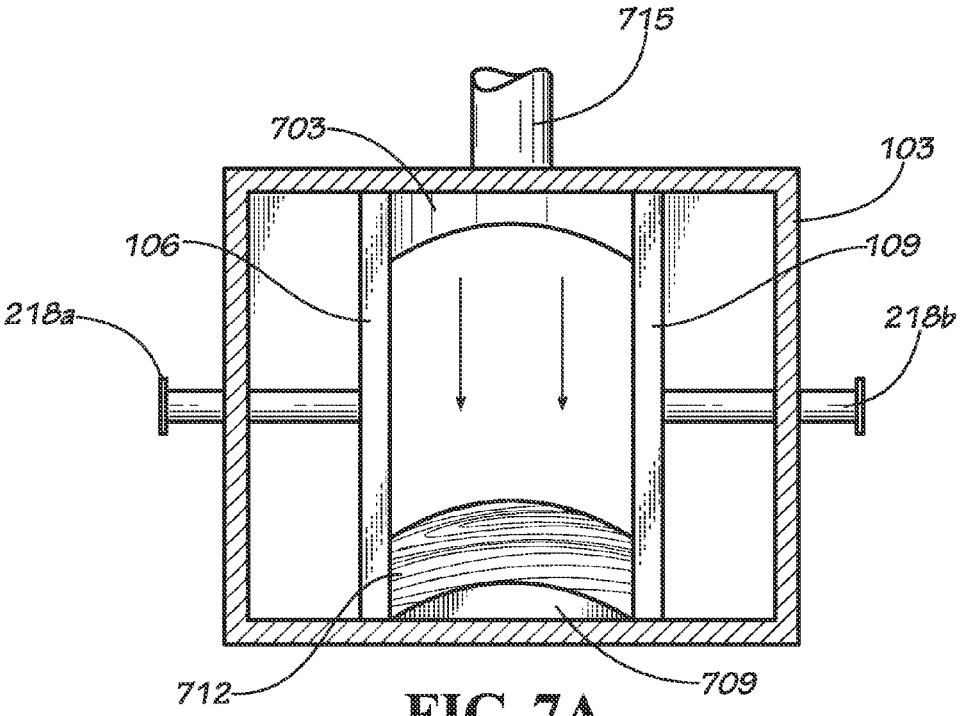
FIG. 7A is a cross-sectional view of an exemplary autoclave with shaped platens, according to one embodiment of the present disclosure.
Figure 7B:
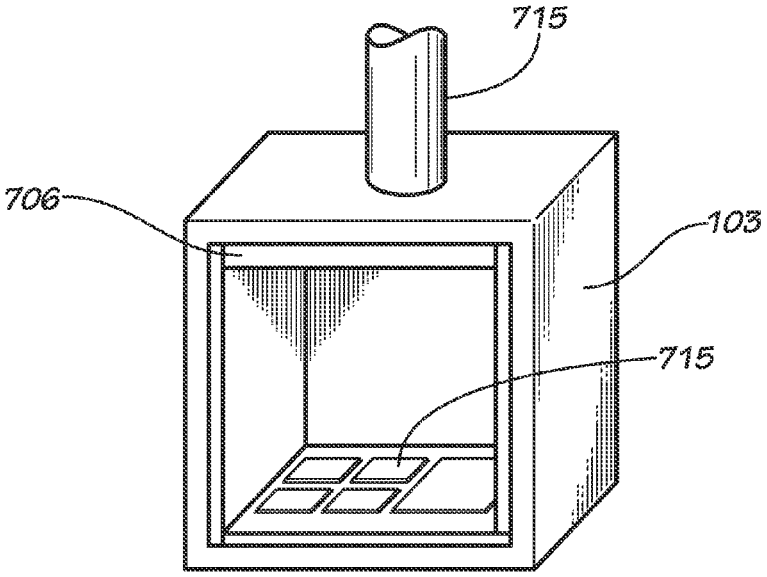
FIG. 7B is a perspective view of an exemplary autoclave with shaped platens, according to one embodiment of the present disclosure.

In one embodiment, the top platen of the autoclave 103 comprises a non-conventional shape for manufacturing wood products of different shapes. In an exemplary embodiment shown in FIG. 7A, the top platen 703 generally comprises a curved surface facing the working material and the bottom plate 709. The curvature of the top platen 703 can be designed in accordance with the curvature of the bottom plate 709 so that they form an arched rigid member if the top platen 703 were to be lowered to contact the bottom plate 709. During operation of the steam pressing apparatus, the driving rod 715 is operated to lower the platen 703 to contact the upper surface of the working material. The resultant dimensions and shape of the mat 709 are determined by the inner space formed by the top platen 703, the bottom plate 709 and the side plates 106, 109. In another embodiment illustrated in FIG. 7B, the top platen 706 and bottom plate 715 are shaped so that they form custom shapes, such as a door, fence, window structure, furniture, or other shapes and objects.

Automated Control

In one embodiment, the steam pressing apparatus 100 is designed to respond to computerized instructions relating to the pressure to be applied, steam to be applied, vacuum parameters, timing of the press operation, thickness of the resultant working material, and other informational inputs. In one aspect, the hydraulic system moving the driving rods 115, the side hydraulic cylinders 145, the steam injection system and the vacuum system comprise electronic actuators or similar devices connected to a central computer system, such as a central embedded microprocessor with an external memory or a central microcontroller. In one embodiment, the hydraulic system moving the driving rods 115 and the side hydraulic cylinders 145 operates via hydraulic fluid at a predetermined pressure to move the various components. In one embodiment, the central computer system is a programmable logic controller (PLC) designed for multiple input and output arrangements, extended temperature ranges, immunity to electrical noise, and resistance to vibration and impact during the manufacturing process. In one embodiment, the central computer system has digital and analog inputs for communication with the pressure and temperature sensors located inside of the autoclave 103. The sensors can be either digital or analog, and communicate with the embedded computer via an analog-to-digital converter or a digital communication protocol such as $I^2C$ or SPI.

In one aspect, the temperature and pressure sensors are connected to an embedded microcontroller or similar computer system, which is connected to a transceiver and an antenna. In one aspect, each sensor is connected to an independent computer system. The embedded microprocessor or microprocessors command the sensors to determine the temperature and pressure in the autoclave 103, and the temperature and pressure values are transmitted wirelessly to a central computer system such as a central embedded microcontroller also connected to a transceiver and an antenna. In one aspect, the sensors and the central computer system communicate using a wireless sensor protocol, where the central computer and the sensors form a wireless sensor network. A system to detect motion comprising one or more devices such as encoders, infrared transceivers, or inertial measurement units is placed inside of the autoclave 103 to track the movement of the top platen 118 and the side plates 106, 109. In one embodiment, the system to detect motion communicates with the central computer system in a similar fashion as the temperature and pressure sensors. In one aspect, the central computer system stores pressure, temperature, timing, size and any other informational data required for the manufacture of different types of wood products. In one aspect, the central computer system is operated to create an open-loop or closed-loop feedback system among the sensors, the motion detection system and the actuators in the steam pressing apparatus 100. The actuators respond and move the parts of the steam pressing apparatus 100 according to the manufacture requirements of the different working materials stored in the memory of the computer system.

As previously described, an exemplary automation system operates the steam pressing apparatus according to a predetermined hydraulic pressure that moves the platens within the steam pressing apparatus 100 and controls the steam according to various predetermined parameters to successfully operate the steam pressing apparatus 100. FIG. 8 is a graph 800 illustrating an exemplary set of operating times, hydraulic operating pressures 801, and steam operating pressures 803 as would be used in an automated process apparatus operation process, according to one embodiment of the present disclosure. In particular, the information included in the graph 800 could be provided to a computerized system operatively coupled to the steam pressing apparatus, such that the input parameters derived from the graph would be used to operate the steam pressing apparatus in an automated fashion. As will be generally understood, the following exemplary steam pressures, hydraulic system pressures, and times are for exemplary purposes only and are not intended to limit the spirit or the scope of the present disclosure.

As will be generally understood and in one embodiment, at time equals zero or before the steam pressing apparatus 100 begins operating, the steam pressure 803 and the hydraulic pressure 801 are typically at zero. In certain embodiments, the hydraulic pressure and/or the steam pressure are at a particular pressure prior to time equals zero or when the steam pressing apparatus begins operating. Upon receiving an indication at the computerized system to operate the steam pressing apparatus 100, the steam pressure 803 increases to approximately 600 kPa in approximately 60 seconds, as shown at inflection point 805. According to one aspect of the present embodiment, 600 kPa is a set point for initiating operation of the hydraulic system 820. In another aspect, the set point for initiating operation of the hydraulic system 820 is 60 seconds of lapsed time from receiving an indication to operate the steam pressing apparatus 100. As shown at time 820, the hydraulic system initiates operation according to a predetermined parameter and the hydraulic pressure reaches 17 kPa, wherein at 17 kPa the door of the steam pressing apparatus 100 begins closing and the platens begin to press the wood (or other working material) within the steam press apparatus.

As shown in FIG. 8, the steam pressure generally remains constant at 600 kPa during the pressing operation (e.g., for 310 seconds or until the total time for steam operation is at 370 seconds and reaches point 810, as shown in this particular non-limiting example). Accordingly, the press remains closed until the total elapsed time of operation for the steam press apparatus 100 is approximately 440 seconds as shown at time 815. Further, and in one embodiment, the hydraulic pressure begins to decay to 0 kPa after a total elapsed time of operation for the steam press apparatus reaches 610 seconds. In one embodiment (not shown), the hydraulic pressure 801 of the hydraulic system maintains the hydraulic pressure at approximately 17 kPa even when the hydraulic system is not in use. Further, in another embodiment (not shown) the steam pressure remains at or close to operating steam pressure, which is approximately 600 kPa, and a further mechanism activates to enable the constantly pressurized steam into the steam pressing apparatus.

FIG. 9 is a graph 900 illustrating an another set of exemplary operating times, hydraulic operating pressures 901, and steam operating pressures 903, according to one embodiment of the present disclosure. As will be generally understood, the following exemplary steam pressures, hydraulic system pressures, and times are for exemplary purposes only and are not intended to limit the spirit or the scope of the present disclosure. In one embodiment, at time equals zero or before the steam pressing apparatus 100 operates the steam pressure 903 and the hydraulic pressure 901 is at zero. In certain embodiments, the hydraulic pressure and/or the steam pressure are at a particular pressure prior to time equals zero or the steam pressing apparatus begins operating.

Upon receiving an indication to operate the steam press apparatus 100, the steam pressure 903 increases to approximately 600 kPa in approximately 60 seconds, as shown at time 905. According to one aspect of the present embodiment, 600 kPa is a set point for initiating operation of the hydraulic system 920. In another aspect, the set point for initiating operation of the hydraulic system 920 is 60 seconds of lapsed time from receiving an indication to operate the steam pressing apparatus 100. As shown at time 920, the hydraulic system initiates operation according to a predetermined parameter and thereafter the hydraulic pressure increases to 17.5 kPa, wherein at 17.5 kPa the doors within the steam pressing apparatus 100 begin closing and the platens begin pressing the wood (or other working material) within the steam press apparatus.

As shown in FIG. 9 the steam pressure generally remains constant at 600 kPa for 380 seconds or until the total time for steam operation is at 440 seconds 910. As will be generally understood, the steam pressure decays, returning to 0 kPa after approximately 610 seconds of steam press operation. Accordingly, the press remains closed until the total elapsed time of operation for the steam press apparatus 100 is approximately 400 seconds as shown at 915. Further, and in one embodiment, the hydraulic pressure begins to decay to 0 kPa after a total elapsed time of operation for the steam press apparatus reaches 610 seconds. In one embodiment (not shown), the hydraulic pressure 901 of the hydraulic system maintains the hydraulic pressure at approximately 17.5 kPa even when the hydraulic system is not in use. Further, in another embodiment (not shown) the steam pressure remains at or close to operating steam pressure, which is approximately 600 kPa, and a further mechanism activates to enable the constantly pressurized steam to enter the steam pressing apparatus.

The foregoing description of the exemplary embodiments has been presented only for the purposes of illustration and description and is not intended to be exhaustive or to limit the inventions to the precise forms disclosed. Many modifications and variations are possible in light of the above teaching. Further, the foregoing times, steam pressures, hydraulic pressures, and other parameters were for exemplary purposes only and were not intended to limit the spirit or the scope of the present disclosure. As will be generally understood by one of ordinary skill in the art, various steam pressures, times, hydraulic pressures, and other parameters may be utilized to press a charge of wood into a resultant product.

In view of the foregoing detailed description of preferred embodiments of the present disclosure, it readily will be understood by those persons skilled in the art that the present disclosure is susceptible to broad utility and application. While various aspects have been described in the context of a preferred embodiment, additional aspects, features, and methodologies of the present disclosure will be readily discernible from the description herein, by those of ordinary skill in the art. Many embodiments and adaptations of the present disclosure other than those herein described, as well as many variations, modifications, and equivalent arrangements and methodologies, will be apparent from or reasonably suggested by the present disclosure and the foregoing description thereof, without departing from the substance or scope of the present disclosure. Furthermore, any sequence (s) and/or temporal order of steps of various processes described and claimed herein are those considered to be the best mode contemplated for carrying out the present disclosure. It should also be understood that, although steps of various processes may be shown and described as being in a preferred sequence or temporal order, the steps of any such processes are not limited to being carried out in any particular sequence or order, absent a specific indication of such to achieve a particular intended result. In most cases, the steps of such processes may be carried out in a variety of different sequences and orders, while still falling within the scope of the present disclosures. In addition, some steps may be carried out simultaneously.

The embodiments were chosen and described in order to explain the principles of the disclosures and their practical application so as to enable others skilled in the art to utilize the disclosures and various embodiments and with various modifications as are suited to the particular use contemplated. Alternative embodiments will become apparent to those skilled in the art to which the present disclosures pertain without departing from their spirit and scope. Accordingly, the scope of the present disclosures is defined by the appended claims rather than the foregoing description and the exemplary embodiments described therein.

What is claimed is:

1. An automated modular system for manufacturing a wood product of varying dimensions from a charge of working material comprised of a reconsolidated wood product, comprising:

a steam pressing apparatus comprising a plurality of axially aligned and connected modular autoclave sections for applying steam and compression to the charge of working material introduced into the system, the plurality of autoclave sections having at least one open end for introducing and removing the charge of working material;

each of the plurality of modular autoclave sections comprising:

an inner chamber for receiving and compressing a portion of an elongate charge of working material;

at least one open end for coupling to an adjacent autoclave section;

one or more platens within the inner chamber for compressing the charge of working material contained within the inner chamber;

one or more driving rods extending into the inner chamber for moving the one or more platens; and one or more coupling plates extending along the borders of each of the plurality of autoclave section for attaching and tightly sealing each autoclave section to at least one other adjacent autoclave section;

a supporting structure comprising a modular system of rigid vertical and horizontal members positioned around and supporting each of the plurality of modular autoclave sections to form a complete steam pressing apparatus;

at least one of the autoclave sections including a sliding door for an open end and secured to the supporting structure for providing access to the chambers of each of the plurality of autoclave sections for introducing and removing the charge of working material;

one or more steam inlets for introducing steam into the chambers of each of the plurality of autoclave sections; and an automated control system operatively connected to the steam pressing apparatus, the automated control system having a processor configured to autonomously execute pressing of the charge of wood into the predetermined profile via actuating the driving rods for each of the plurality of autoclave sections and controlling the introduction of steam into the apparatus in accordance with a predetermined combination of operating parameters comprising at least time, steam pressure, and compression with the plurality of platens.

2. The automated system of claim 1, further comprising:

a hydraulic system comprising a plurality of hydraulic cylinders coupled to a plurality of hydraulic drives operatively coupled to the plurality of driving rods of each of the plurality of autoclave sections for effectuating movement of the one or more platens; and a steam injection system operatively coupled to the steam inlets of the steam pressing apparatus so as to distribute pressurized steam to the charge of wood, wherein the pressurized steam is injected into the steam pressing apparatus at a predetermined steam pressure.

3. The automated system of claim 2, wherein the processor is further configured to:

receive a request at the automated control system to initiate execution of pressing the charge of wood into the predetermined profile;

operate the hydraulic system at a predetermined hydraulic system pressure for effectuating the movement of the one or more platens; and inject distributed pressurized steam into the steam pressing apparatus at the predetermined steam pressure.

4. The automated system of claim 3, wherein the processor is further configured to:

receive a request at the automated control system to end execution of pressing the charge of wood into the predetermined profile;

conclude injection of distributed pressurized steam into the steam pressing apparatus at the predetermined steam pressure;

discharge distributed pressurized steam from the steam pressing apparatus; and conclude operation of the hydraulic system comprising of returning the one or more platens to a predetermined starting position, such that the charge of wood is formed into the predetermined profile.

5. The automated system of claim 1, further comprising at least one of the following: an actuator, a sensor, a motion detection system.

6. The automated system of claim 1, further comprising a vacuum system for discharging distributed pressurized steam from the steam pressing apparatus.

7. The automated system of claim 1, wherein at least some of the plurality of platens include mechanical stops for adjusting the height of the predetermined profile.

8. The automated system of claim 1, wherein the steam pressing apparatus further comprises a plurality of adjustable side plates arranged in a stepwise fashion for adjusting the width of the predetermined profile.

9. The automated system of claim 1, wherein the system includes a sliding door at each end of the plurality of autoclave sections.

10. The automated system of claim 1, wherein the one or more platens in each autoclave section are top platens.

11. The automated system of claim 10, further comprising one or more side platens for applying compression to the charge of working material from at least one side of the charge of working material.

12. The automated system of claim 1, wherein the predetermined combination of operating parameters comprising at least time, steam pressure, and compression with the plurality of platens comprises:

applying steam pressure within the apparatus to a predetermined steam pressure;

applying compression to the charge of working material after the steam pressure has reached the predetermined steam pressure, to a predetermined hydraulic pressure;

maintaining the predetermined steam pressure and the predetermined hydraulic pressure for a predetermined first time;

releasing the predetermined steam pressure after the predetermined first time; and releasing the predetermined hydraulic pressure after a predetermined second time.

13. The automated system of claim 1, wherein the predetermined combination of operating parameters comprising at least time, steam pressure, and compression with the plurality of platens comprises:

applying steam pressure within the apparatus to a predetermined steam pressure;

applying compression to the charge of working material after the steam pressure has reached the predetermined steam pressure, to a predetermined hydraulic pressure;

maintaining the predetermined steam pressure and the predetermined hydraulic pressure for a predetermined first time;

releasing the predetermined hydraulic pressure after the predetermined first time; and releasing the predetermined steam pressure after a predetermined second time.

* * * * *